United States Patent [19]

Hofmann

[11] 4,407,500

[45] Oct. 4, 1983

[54] RACKET HANDLE

[76] Inventor: Ulrich Hofmann, Parkstrasse 4, D-8870 Günzburg, Fed. Rep. of Germany

[21] Appl. No.: 391,719

[22] Filed: Jun. 24, 1982

Related U.S. Application Data

[63] Continuation of Ser. No. 139,453, Apr. 11, 1980, abandoned.

[30] Foreign Application Priority Data

Nov. 7, 1979 [DE] Fed. Rep. of Germany ..... 2944882

[51] Int. Cl.[3] ..... B63B 49/08

[52] U.S. Cl. ..... 273/75; 273/730

[58] Field of Search ..... 273/73 R, 73 C, 73 G, 273/73 H, 73 J, 75

[56] References Cited

U.S. PATENT DOCUMENTS

| | | | |
|---|---|---|---|
| 1,750,644 | 3/1930 | Norton | 273/73 J |
| 2,086,062 | 7/1937 | Bray | 273/73 J X |
| 2,120,280 | 6/1938 | Hall | 273/75 |
| 3,501,148 | 3/1970 | Cheris et al. | 273/75 |
| 3,540,728 | 11/1970 | Palmer | 273/75 X |
| 3,986,716 | 10/1976 | Taussig et al. | 273/73C |
| 4,108,436 | 8/1978 | Masi | 273/75 |

FOREIGN PATENT DOCUMENTS

| | | | |
|---|---|---|---|
| 134426 | 9/1949 | Australia | 273/75 |
| 2263795 | 10/1975 | France | 273/73 J |
| 228650 | 2/1925 | United Kingdom | 273/75 |
| 1510626 | 5/1978 | United Kingdom | 273/75 |

*Primary Examiner*—Richard C. Pinkham
*Assistant Examiner*—Matthew Schneider
*Attorney, Agent, or Firm*—Toren, McGeady & Stanger

[57] ABSTRACT

A handle for a racket of the type used in playing tennis and like sports includes an elongated shaft portion, a hollow grip portion attached to one end of the shaft portion and a frame portion connected to the other end of the shaft portion. The shaft portion includes two spaced apart hollow tube sections which, in their surfaces facing toward each other, are provided with slots extending in the longitudinal direction of the tube sections. The space between the portions of the tube sections which face each other in the transverse direction of the tube sections forms a Venturi region for creating a zone of reduced air pressure between the tube sections when the racket is swung during play. The zone of reduced air pressure cases air to be drawn from the interior of the tube sections through the longitudinal slots. The air drawn through the longitudinal slots is conducted from the tube sections and a passageway formed in the grip portion and through openings provided between the passageway and the periphery of the grip portion. The air flow generated when the racket is swung serves to ventilate the hand and to remove perspiration accumulating during play.

9 Claims, 6 Drawing Figures

RACKET HANDLE

This is a continuation of application Ser. No. 139,453 filed on Apr. 11, 1980 and since abandoned.

SUMMARY OF THE INVENTION

The present invention is directed to the handle for a racket of the type used in playing tennis and like sports, including an elongated shaft portion, a grip portion attached to one end of the shaft portion, and a frame portion connected to the other end of the shaft portion. The shaft portion is formed of two spaced apart hollow tube sections which are provided with longitudinal slots in the regions facing each other. The space between the portions of the tube sections which face each other in the transverse direction of the tube sections forms a Venturi region for creating a zone of reduced air pressure between the tube sections when the racket is swung. This zone of reduced air pressure causes air to be drawn through openings provided in the grip surface and to flow through a passageway formed in the interior of the grip portion and through the hollow tube sections and to be discharged through the longitudinal slots in the tube sections. Thus, the air drawn through the openings from the area surrounding the hand of the player holding the grips serves to remove the perspiration accumulating during the use of the racket.

In a known racket, disclosed in U.S. Pat. No. 3,752,478, the racket handle is formed by two spaced apart shaft tubes which extend parallel of each other and are at one end connected to a grip. A conventional ribbon is wrapped around this grip for reducing the accumulation of perspiration generated on the hand of the player. However, the ribbon does not provide a solution to the problem of effectively removing the perspiration.

In another racket known from U.S. Pat. No. 2,120,280, the handle has a longitudinally extending duct in its interior which is at one end connected to a funnel-shaped air inlet and at its other end to openings provided in the grip portion of the handle in order to generate an air flow at the player's hand for reducing the accumulation of perspiration on the grip portion of the handle.

In this known racket, the air admitted through the funnel-shaped inlet must be deflected into the longitudinal direction of the handle. The turbulence occurring as a result of the airflow significantly reduces the useful cross-sectional area of the duct as compared to its actual cross-sectional area. This known handle has the additional disadvantage that the air inlet opening is relatively small. Accordingly, the problem of preventing an accumulation of perspiration is also not solved in this handle.

Therefore, it is an object of the present invention to provide a racket handle which is designed to afford an improved airflow at the hand gripping the handle to effect ventilation of the hand and removal of perspiration accumulating on the hand during play.

In accordance with the present invention, the racket handle has an elongated shaft portion, a grip portion attached to one end of the shaft portion and a frame portion connected to the other end of the shaft portion. The shaft portion is formed of two spaced apart hollow tube sections. The space between the tube sections incudes means for forming a Venturi region for creating a zone of reduced air pressure between the tube sections when the racket is swung. The zone of reduced air pressure causes air to be drawn from the interior of the tube sections through longitudinal slots provided in the portions of the tube sections which face each other. The interior of the tube sections is in communication with a passageway formed in the interior of the grip portion. A plurality of openings are provided in the grip portion between the passageway and the outer periphery of the grip portion, so that the air surrounding the hand of the player using the racket can be drawn into the passageway through the openings to effect a ventilation of the hand and a removal of perspiration accumulating on the hand during play.

Since the space between the tube sections forming the Venturi region has a substantial length in the longitudinal direction, the air conducted through the handle from the hand of the player results in ventilation of the hand which is much more effective than the ventilation obtained in conventional rackets.

In accordance with a further development of the invention, the tube sections extend parallel of each other over a substantial portion of their length and at least the regions of the tube sections which face each other have streamlined, convex surfaces, with the longitudinal slots being provided at the point of the narrowest space defined by the two convex surfaces.

In accordance with a particularly advantageous feature of the invention, the longitudinal slots provided in the regions of the tube sections which face each other are spaced apart in the longitudinal direction of each tube section in such a manner that the slots are arranged in a staggered relationship.

It is also possible, is accordance with the present invention, to provide an elongated web having a streamlined profile in its transverse cross-section in the space defined by the regions of the tube sections which face each other. The web extends generally parallel of the tube sections. This web has the purpose of accelerating the airflow in the transverse direction of the tube sections in the region of the tube sections which face each other. In addition, the web increases the stability of the shaft portion of the racket, particularly when the web is a solid member.

In accordance with another embodiment of the present invention, the two tube sections forming the shaft portion diverge from the grip portion toward the frame portion. In the substantially triangular region defined by the tube sections and the frame portion, there is provided an air-displacing body having a substantially triangular shape, so that the side edges of the body extend in juxtaposition to the regions of the tube sections and the frame portion which bound the triangular region. The side edges of the air-displacing body can also have a streamlined profile.

A porous ribbon can be wound around the grip portion of the handle covering the openings provided in the grip portion.

The various features of novelty which characterize the invention are pointed out with particularity in the claims, annexed to and forming a part of this disclosure. For a better understanding of the invention, its opeating advantages and specific object attained by its use, reference should be had to the accompanying drawings and descriptive matter in which there are illustrated and described preferred embodiments of the invention.

DETAILED DESCRIPTION OF THE INVENTION

Figure 1:
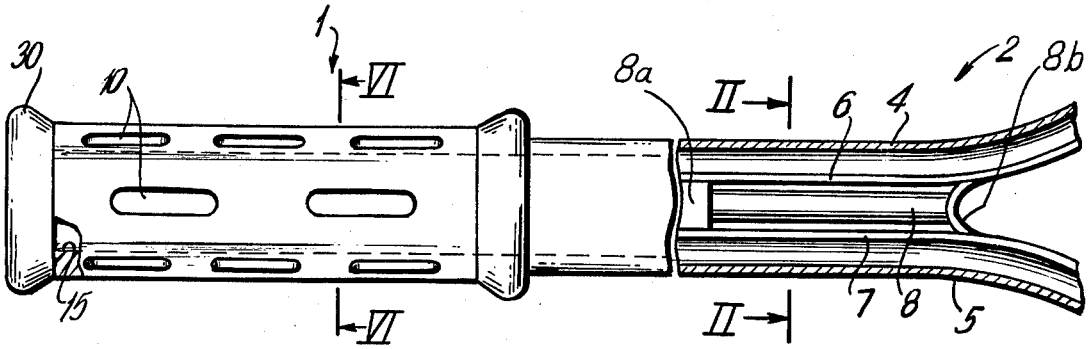
FIG. 1 is a partial, elevational view of a tennis racket embodying the present invention.
Figure 6:
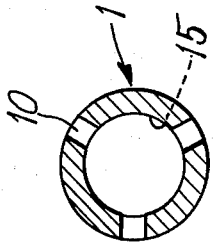
FIG. 6 is a transverse cross-section through the grip portion of the racket along line VI—VI in FIG. 1.

In FIGS. 1, and 6 a handle of a tennis racket is illustrated having a grip portion 1 and a shaft portion 2 connected to the grip portion 1. The grip portion 1 is a hollow member forming a passageway 15 extending therethrough and has openings 10 between the passageway and the outer periphery of the grip portion for allowing air to be drawn from the area surrounding the hand of the player using the racket into the passageway of the grip portion. As illustrated in the drawing, the openings 10 are oblong holes distributed in pattern over the circumference of the grip portion 1. The shaft portion 2 includes two spaced apart hollow tube sections 4 and 5 attached in axial alignment to an end of grip portion 1, so that the interior of the tube sections 4 and 5 communicates with the passageway 15 of the grip portion 1. The space between the portions of the tube sections 4 and 5 which face each other in the transverse direction of the tube sections forms a Venturi region for creating a zone of reduced air pressure between the tube sections when the racket is swung. The portions of the tube sections 4 and 5 which face each other are each provided with slots 6 and 7, shown in FIG. 2, extending generally in the longitudinal direction of the tube sections. The longitudinal slots 6 and 7 can also be spaced apart in the longitudinal direction of the tube sections in such a way that the longitudinal slots 6 and 7 in the tube sections are placed in a staggered relationship.

For an effective airflow in the handle, the passageway 15 in the grip portion 1 is closed to the outside at the end situated opposite the end connected to the shaft portion by means of a cover 30.

Figure 2:
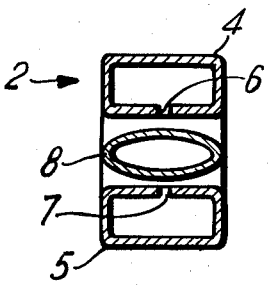
FIG. 2 is a transverse cross-section taken through the tennis racket in FIG. 1 along the sectional line II—II.

In FIGS. 1 and 2, an elongated web member 8 having a streamlined shape in its transverse cross-section is arranged in the space defined by the two tube sections 4 and 5. The ends of the web member engage support members 8*a* and 8*b* disposed between the portions of the tube sections 4 and 5 which face each other. The streamlined web member 8 has the purpose of accelerating the airflow in the transverse direction of the tube sections in the space defined between the two tube sections, when the racket is swung during play. As a result, a zone of reduced air pressure is created adjacent the longitudinal slots 6 and 7 which causes air to be drawn from the interior of the tube sections. The air is conducted from the area surrounding the hand of the player holding the racket through the openings 10, the passageway 15 in the grip portion 1 and the interior of the tube sections 4 and 5 and is discharged through the slots 6 and 7, thereby ventilating the hand and drawing off hot air and perspiration generated on the hand during play.

Figure 3:
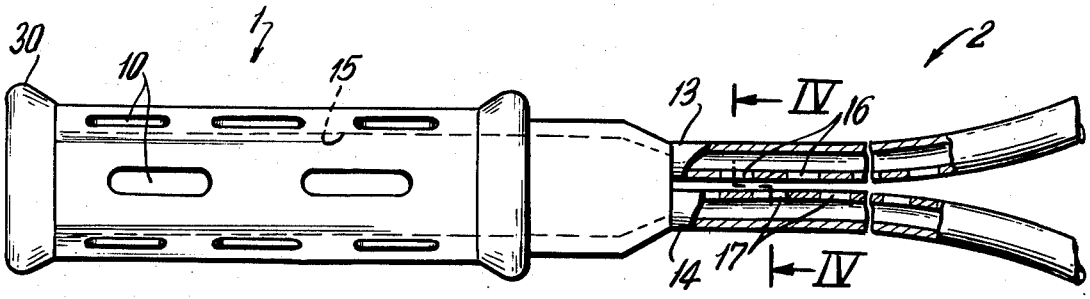
FIG. 3 is a partial, elevational view of another embodiment of the present invention.
Figure 4:
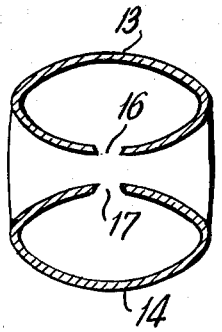
FIG. 4 is a transverse cross-section taken through the tennis racket in FIG. 3 along the sectional line IV—IV.

FIGS. 3 and 4 show the handle of a racket in which the shaft portion 2 includes two tube sections 13 and 14 which have a streamlined shape in their transverse cross-section and are attached in axial alignment to an end of the grip portion. The longitudinal slots 16 and 17 are provided along the point of the narrowest space defined between the tube sections 13 and 14. FIG. 3 shows the staggered relationship of the slots 16 and 17 in the longitudinal direction of the tube sections. As a result of this configuration, during play, a zone of reduced air pressure is created adjacent the longitudinal slots 16 and 17 and air is drawn from the area surrounding the hand of the player and is conducted through the openings 10 and the passageway 15 in the grip portion 1, and flows from the passageway 15 into the interior of the tube sections 13 and 14 and is discharged through the longitudinal slots 16 and 17.

Figure 5:
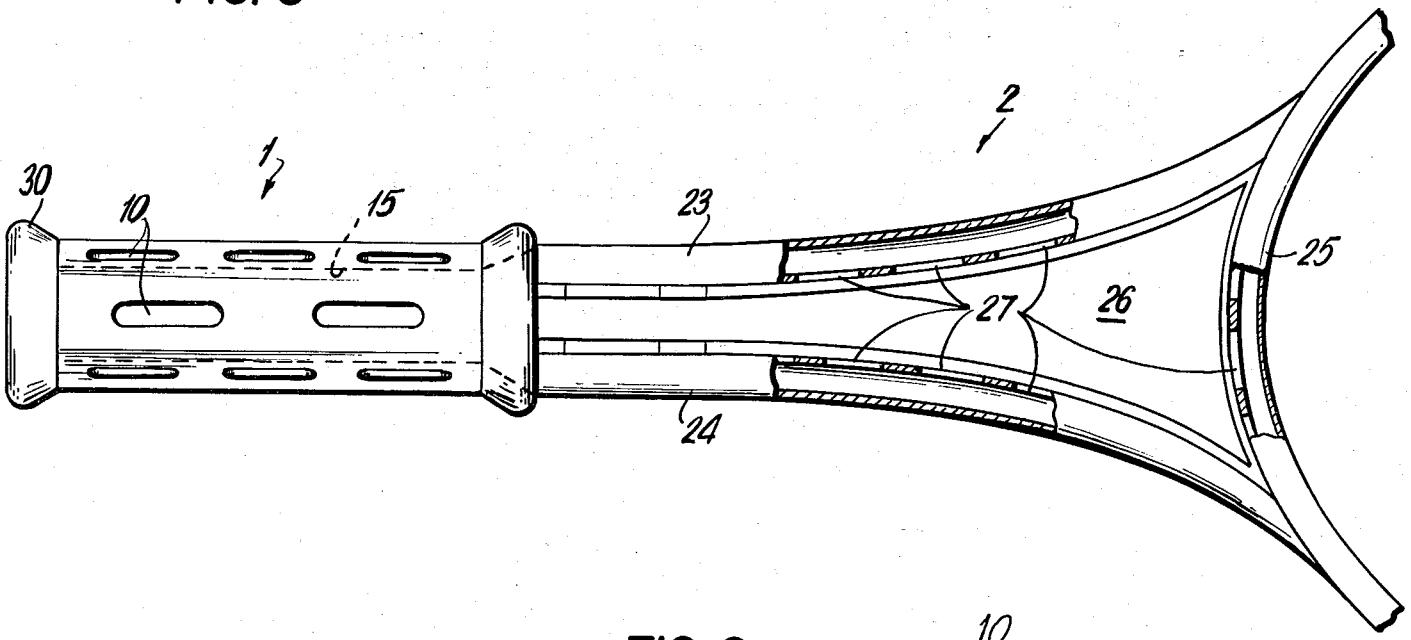
FIG. 5 is a partial, elevational view of yet another embodiment of the present invention.

In the embodiment according to FIG. 5, the tube sections 23 and 24 of the shaft portion 2 diverge from the grip portion 1 toward the frame portion 25. In the space defined between the tube sections 23 and 24 and the frame portion 25, an air-displacing body 26 is arranged uniformly spaced apart from the tube sections 23 and 24 and the frame portion 25, the side edges of the body 26 facing the tube portions 23 and 24 and the frame portion 25 having a streamlined profile, not shown. The portions of the tube sections 23 and 24 and of the frame portion 25 facing this air-displacing body 26 are also provided with streamlined profiles. At least the part of the frame portion 25 which is disposed in juxtaposition to the air-displacing body 26 is hollow. Slots 27 are provided in the tube sections 23 and 24 and the frame portion 25 at the narrowest point of the space defined between the air-displacing body 26 and the tube sections 23 and 24 and the frame portion 25. To remove perspiration and to ventilate the hand of the player, a zone of reduced air pressure is created adjacent the slots 27 and air is drawn from the area surrounding the hand of the player through the openings 10 and is conducted through the passageway 15 of the grip portion 1 and through the interior of the tube sections 23 and 24 and the frame portion 25 and is discharged through the slots 27.

While specific embodiments of the invention have been shown and described in detail to illustrate the application of the inventive principles, it will be understood that the invention may be embodied otherwise without departing from such principles.

What is claimed is:

1. A racket of the type used in playing tennis and like sports, comprising an elongated shaft portion, a hollow grip portion having a forward portion and a butt portion with said forward portion being attached to one end of said shaft portion, said one end terminating within and adjacent to said forward portion of said grip, a frame portion connected to the other end of said shaft portion, said shaft portion including two spaced apart hollow tube sections, the space between the portions of said tube sections which face each other in the transverse direction of said tube sections including means for forming a Venturi region for creating a zone of reduced air pressure between said tube sections when the racket is swung, said portions being provided with slots extending generally in the longitudinal direction of said tube sections for allowing said zone of reduced air pressure to communicate with the interior of said tube sections, the interior of said grip portion forming a passageway for communicating air with the interior of said tube sections, said grip portion having a plurality of openings between said passageways and the outer periphery of said grip portion for allowing air to be drawn from the hand of a player using the racket, wherein said openings in said grip portion, said passageway in said grip portion, the interior of said tube sections and said Venturi region are adapted to conduct air therethrough from the hand of the player when the racket is swung, so that perpspiration accumulating on the hand of the player holding said grip portion is removed by the air drawn in said openings through said passageway of said grip portion.

2. Racket as set forth in claim 1 wherein said tube sections extend parallel of each other over a substantial portion of their length from said grip portion.

3. Racket as set forth in claim 2, wherein at least the portions of said tube sections which face each other are streamlined surfaces convexly converging toward each other in the transverse direction of said tube sections, said slots being arranged at the point of the narrowest space defined by said convex surfaces.

4. Racket as set forth in claims 2 or 3, comprising an elongated web member supported and extending parallel of said tube sections in the space between said tube sections.

5. Racket as set forth in claim 1, wherein said slots are spaced apart in the longitudinal direction of said tube sections, said slots being placed in a staggered relationship relative to each other in said tube sections.

6. Racket as set forth in claim 1, wherein said tube sections diverge from said grip portion toward said frame portion, a body for displacing air being mounted in the space bounded by said tube sections, the side edges of said air-displacing body streamlined, convex surfaces which are disposed in juxtaposition to said tube sections and said frame portion.

7. Racket as set forth in claim 6, wherein a part of said frame portion is disposed in juxtaposition to said air-displacing body and is a hollow tube section whose interior is in communication with the interior of said tube sections, the surface of said part of said frame portion facing said air-displacing body being provided with slots for drawing air from the interior of said part of said frame portion.

8. Racket as set forth in claim 7, wherein the parts of said tube sections and said frame portion which face said air-displacing body have streamlined surfaces.

9. Racket as set forth in claim 1, wherein said portions of said tube sections which face each other converge toward each other in the transverse direction of said tube sections, said means for forming a Venturi region being defined by said converging portions.

* * * * *

UNITED STATES PATENT AND TRADEMARK OFFICE

CERTIFICATE OF CORRECTION

PATENT NO. : 4,407,500

DATED : Oct. 4, 1983

INVENTOR(S) : Ulrich Hofmann

It is certified that error appears in the above-identified patent and that said Letters Patent is hereby corrected as shown below:

In the heading of the patent [30] should read as follows:

[30] Foreign Application Priority Data

-- Nov. 7, 1979 [DE] Fed. Rep. of Germany.....2944982 --.

Signed and Sealed this

Twenty-first Day of February 1984

[SEAL]

*Attest:*

GERALD J. MOSSINGHOFF

*Attesting Officer*

*Commissioner of Patents and Trademarks*